US006058515A

United States Patent [19]

Kitahara

[11] Patent Number: 6,058,515

[45] Date of Patent: May 9, 2000

[54] HELMET

[75] Inventor: Hideshi Kitahara, Kawaguchi, Japan

[73] Assignee: TS Tech Co., Ltd., Japan

[21] Appl. No.: 09/340,180

[22] Filed: Jun. 28, 1999

[30] Foreign Application Priority Data

Aug. 31, 1998 [JP] Japan ..... 10-259195

[51] Int. Cl.[7] ..... A42B 3/12

[52] U.S. Cl. ..... 2/412; 2/414

[58] Field of Search ..... 2/410, 411, 412, 2/414, 425

[56] References Cited

U.S. PATENT DOCUMENTS 5,056,162 10/1991 Tirums ..... 2/412
5,943,706 8/1999 Miyajima et al. ..... 2/412

FOREIGN PATENT DOCUMENTS 60-81307 5/1985 Japan .
63-282303 11/1988 Japan .
9176908 7/1997 Japan .

*Primary Examiner*—Michael A. Neas
*Attorney, Agent, or Firm*—Lorusso & Loud

[57] ABSTRACT

A helmet of the present invention including a shell formed from a thermoplastic resin and a shock absorbing liner disposed on the inside of the shell.

The liner has following varieties of its structure. That is, a single layered structure of acrylonitrile-styrene copolymer resin foam (thereinafter referred to AS foam), a double layered structure in which both less foaming layer and highly foaming layer are made of AS foam, a double layered structure in which a less foaming layer is made of AS foam and a highly foaming layer is made of a foam of other material, or a double layered structure in which a less foaming layer is made of a foam of material other than AS foam and a highly foaming layer is made of AS foam.

5 Claims, 6 Drawing Sheets

HELMET

BACKGROUND OF THE INVENTION

1. Field of the Invention

The present invention concerns a helmet and it particularly relates to a helmet which is worn as a safety cap for sport upon driving of a two wheeled vehicle or four wheeled vehicle and to such a helmet in which a shock absorbing liner is improved.

2. Statement of the Related Art

Heretofore, a helmet has a shell on an outer side and a shock absorbing liner disposed along the inside of the shell. As the shock absorbing liner, polystyrene (PS) foam, polypropylene (PP) foam and the like have been used but PS foam has drawbacks of undergoing large impact acceleration at high temperature, having poor restorability after releasing compression upon impact shock, and shrinking and being transformed at a high temperature of 70° C. or higher. Further, PP foam has a drawback of undergoing a large reduction in compression strength at high temperature.

Further, in helmets using thermoplastic resins for the shell members, it has been difficult in view of strength or the like to satisfy JIS class C standards (Helmets for racing) due to the foregoing drawbacks of the shock absorbing liner. For satisfying the JIS C standards, FRP of high strength is used as the shell material or the thickness of the liner is increased for coping with the foregoing problems.

The related art, use of FRP of high strength as the shell material or increase in the thickness of the liner, results in drawbacks in that the shape of the helmet is enlarged, the helmet is made heavy, production cost is increased or users' demand can not be satisfied in view of the design.

By using polyvinylidene chloride (PVDC) foam as an impact shock absorbing liner, the above-mentioned drawbacks are able to be improved. However, since foaming gases of PVDC foam scarcely escape, an impact shock absorbing liner that is made of PVDC foam has a drawback of swelling at a high temperature of 70° C. or higher. Taking the possible situation into consideration, that a helmet is left under the open sky or put in a helmet box of a motorcycle parked outdoors in midsummer, it is desirable that this drawback of PVDC foam is improved.

Further, since it takes a long period of time for foaming of PVDC foam, the cost of helmet production becomes expensive. Furthermore, since PVDC foam is manufactured with freon as a foaming agent and contains chlorine in its molecule, a substitution for PVDC foam is desired to be developed in view of an influence to the environment.

OBJECT ANS SUMMARY OF THE INVENTION

An objection of the present invention is to provide a helmet showing excellent impact shock absorption, high performance storability upon impact shock, and excellent impact shock absorption upon a second hit on and after on same spot as well. Another objection of the present invention is to provide a helmet that has high heat resistance and does not shrink, swell or deteriorate under the blazing sun in midsummer. A further objection of the present invention is to provide a helmet that is able to be produced without using freon as a foaming agent.

The present invention is to be explained based on claims.

The present invention concerns a helmet H comprising a shell 10, formed by molding of a thermoplastic resin, and an impact shock absorbing liner 20 adhered on the inside of the shell 10. The impact shock absorbing liner 20 of the helmet H of the present invention comprises a layer formed of acrylonitrile-styrene copolymer resin foam. The reasons of making the impact shock absorbing liner 20 comprise the layer formed of acrylonitrile-styrene copolymer resin foam are that acrylonitrile-styrene copolymer resin foam has following advantages. That is, excellent impact shock absorption, high restorability, excellent impact shock absorption upon a second hit on and after, high heat resistance, and being able to be foamed without freon, etc..

Accordingly, the helmet H of the present invention shows excellent impact shock absorption, high performance storability upon impact shock, and excellent impact shock absorption upon a second hit on and after on same spot as well. Besides, the helmet H of the present invention does not shrink, swell or deteriorate under the blazing sun in midsummer.

The shock absorbing liner 20 of the present invention is made to have a single layered structure formed of only acrylonitrile-styrene copolymer resin foam. The shock absorbing liner 20 of the present invention may also be made to have a double layered structure formed of a acrylonitrile-styrene copolymer resin foam 21 and a highly foaming acrylonitrile-styrene copolymer resin foam 22, which is higher foaming than the aforesaid acrylonitrile-styrene copolymer resin foam 21. In this case, the highly foaming acrylonitrile-styrene copolymer resin foam 22 is adhered on the inside of the acrylonitrile-styrene copolymer resin foam 21.

As described above, in making the shock absorbing liner 20 of the present invention have a double layered structure, the less foaming layer 21, since it has comparatively high density, widely disperses the impact shock through shell 4 while appropriately absorbing it upon impact shock onto the helmet H. Then it transmits the impact shock to the highly foaming layer 22. By widely dispersing and absorbing the impact shock in two stages, the pressure from the less foaming layer 21 to the highly foaming layer 22 is moderated and the highly foaming layer 22, which has comparatively low density, effectively absorbs the pressure while easily being compressed and transformed. Thus, the use of the impact shock absorbing liner 20 of the present invention provides excellent performance of shock reducing without remarkably increasing the thickness of the shock absorbing liner 20, which enables the helmet H to protect a user's head from impact shock.

The shock absorbing liner 20 of the present invention may be made to have a double layered structure formed of the acrylonitrile-styrene copolymer resin foam 21 and a foam 22 of other material that is higher foaming than the aforesaid acrylonitrile-styrene copolymer resin foam 21. In this case, the foam 22 of other material is adhered on the inside of the acrylonitrile-styrene copolymer resin foam 21.

Further, the shock absorbing liner 20 of the present invention may be made to have a double layered structure formed of a foam 21 of material other than acrylonitrile-styrene copolymer resin and the acrylonitrile-styrene copolymer resin foam 22 that is higher foaming than the aforesaid foam 21. In this case, the acrylonitrile-styrene copolymer resin foam 22 is adhered on the inside of the foam 21 of other material.

The reason that foams of material other than acrylonitrile-styrene copolymer resin foam may be used, is as follows. That is, in terms of efficiencies such as shock absorption, shock absorption upon a second or more hit on and after, or heat resistance, it is desirable to use acrylonitrile-styrene copolymer resin foam as the less foaming layer and acrylonitrile-styrene copolymer resin foam as the highly foaming layer, which is able to provide a production with the highest quality. However, the cost of acrylonitrile-styrene copolymer resin foam is comparatively expensive.

Consequently, since there is a possibility of providing a sufficient quality with a helmet of low standard by using a foam of other material as either one of the two layers, 21 or 22, of the double layered structure, it is suitable to adapt the use to the purposed quality and cost of the production.

DETAILED DESCRIPTION OF PREFERRED EMBODIMENTS

A preferred embodiment of the present invention will be explained with reference to the drawings. Members, arrangement, and the like to be explained do not restrict the present invention and can be modified variously within the scope of the present invention.

Figure 1:
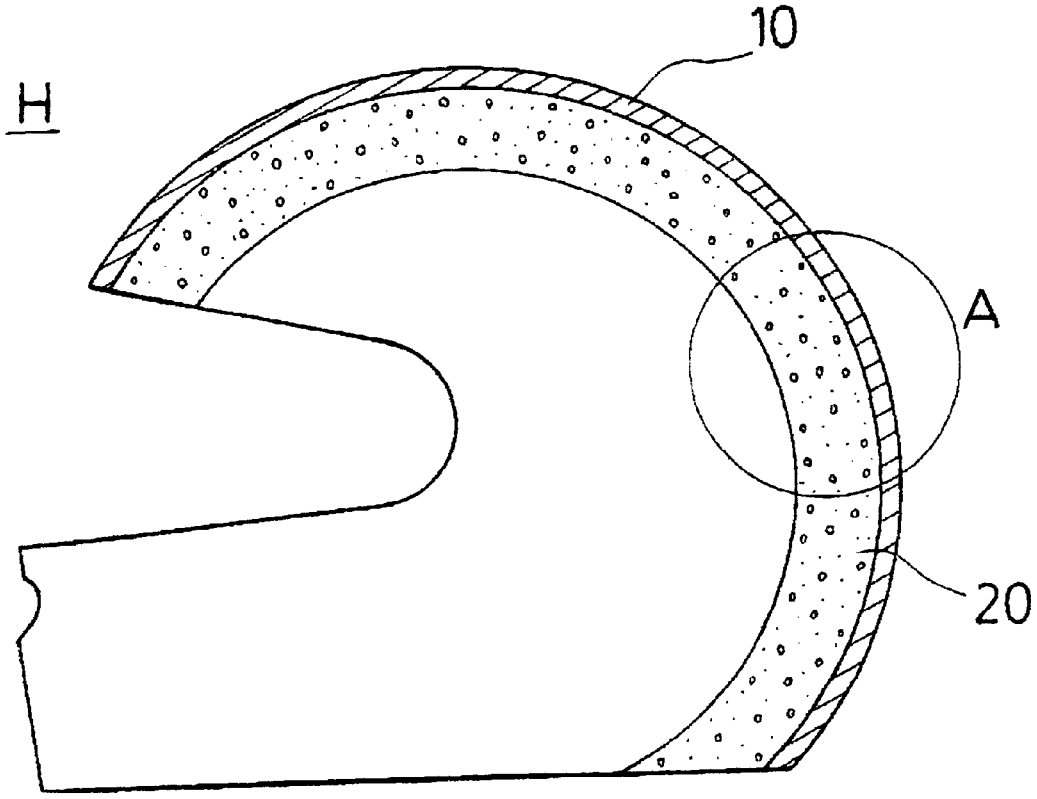
FIG. 1 is a schematic cross sectional view of a helmet according to the present invention.

As shown in FIG. 1, a helmet H of this embodiment is a full face type helmet in which a shell 10 forms the outside, and a shock absorbing liner 20 is disposed along the inside of the shell 10. The shell 10 of this embodiment is made from PP (polypropylene), ABS resin (acrylonitrile-butadiene-styrene), PA (polyamide), A/EPDM/S (acrylonitrile/ethylene•propylene•diene/styrene), FRP (fiber reinforced plastic), PC (polycarbonate), PET (polyethylene terephthalate), PS (polystyrene) or the like, which are thermoplastic resins, and formed into a predetermined shape by injection molding, blow molding, or similar other molding.

Figure 2:
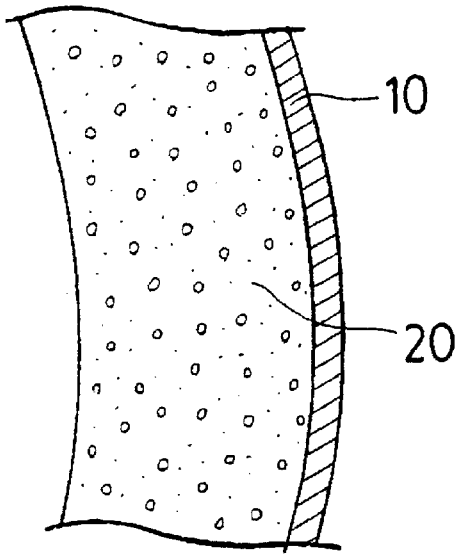
FIG. 2 is an enlarged cross sectional view for a portion A in FIG. 1.

The shock absorbing liner 20 is disposed along the inside of the shell 10. As shown in FIG. 1 and FIG. 2, the shock absorbing liner 20 of this embodiment is composed of a foam of a single density of acrylonitrile-styrene copolymer resin (hereinafter referred to AS). And it is formed to a predetermined thickness and conformed to the inner shape of the shell 10 so as to fit the inside of the shell 10. The shock absorbing liner 20 of this embodiment has a single layered structure.

As the impact shock absorbing liner 20 of this embodiment, such AS foam is used that is made of AS beads prepared up to nine to forty times of the original volume, which originally has a density of 1.0 g/cm$^3$. That is, AS foam, which is used as the impact shock absorbing liner 20 of this embodiment, has a density of 0.11 g/cm$^3$ to 0.025 g/cm$^3$. This AS foam is able to be manufactured with a blow molding equipment, conventionally used for foaming of polystyrene (PS), under almost the same conditions of PS foam. Accordingly, the impact shock absorbing liner 20 of this embodiment has an advantage in which it is not necessary to set up a new blow molding equipment for manufacturing. And since it does not take so long for foaming as foaming of polyvinylidene chloride (PVDC) foam, AS foam also has an advantage of being able to be manufactured efficiently.

As the method of manufacturing expansion moldings, the known method of foam molding may be used. For example, to start with pre-foaming of AS beads, which comprise a foaming agent, by heating with such heating medium as steam, boiling water, burning air or the like, condensed foaming particle are obtained. The heating conditions are adjusted to aiming expansion ratio. Then this condensed foaming particle are charged into a metallic frame which is fit for the purpose and expansion moldings are manufactured by heating this with steam or the like.

AS foam which is used for the impact shock absorbing liner 20 of this embodiment has the property of high heat resistance. Because of this, the impact shock absorbing liner 20 shows excellent heat resistance and does not shrink, swell or hardly deteriorate when exposed to the such atmosphere of high temperature as in a car or helmet box of a motor scooter in midsummer. It is proved that AS foam has excellent heat resistance from the test result of heat resistance of AS foam and PS foam (Comparative Test 1).

Further, As AS foam has excellent heat resistance and its efficiencies are hardly deteriorated even at high temperature, the shock absorbing liner 20 of this embodiment is able to provide a low impact value at high temperature. Accordingly, the impact shock absorbing liner 20 of this embodiment is able to prevent deterioration of impact shock absorption at high temperature more than foams of PS or other material. Further, since it is able to prevent deterioration of impact shock absorption at high temperature, the use of the impact shock absorbing liner 20 of this embodiment is able to make a production lighter than a related production of foamed styrols or other similar material. As is apparent from the below-mentioned test result of impact shock absorption in an atmosphere of high temperature (Comparative Test 2), the impact value of AS foam is proved to be low at high temperature.

As is apparent from the below-mentioned test result of impact shock absorption in an atmosphere of low temperature (Comparative Test 2), AS foam of low density is proved to provide a low impact value at low temperature (−10° C.).

AS foam which is used for the shock absorbing liner 20 of this embodiment has a property of high restorability upon release of compression. Since the shock absorbing liner 20 has excellent restorability upon releasing of compression, it is able to provide a lower impact value upon second hit on and after on same spot compared with foams of PS or other material. AS foam is proved to have excellent restorability upon releasing of compression from the below-mentioned test results of impact shock absorption upon second and third hits (Comparative Test 2), and restorability (Comparative Test 3).

Figure 3:
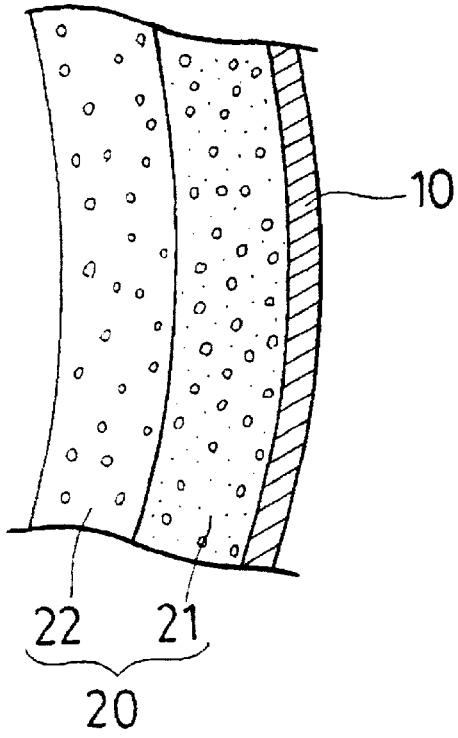
FIG. 3 is an enlarged cross sectional view similar to FIG. 2.

FIG. 3 shows another embodiment of the present invention, which is an enlarged cross sectional view similar to FIG. 2. This embodiment shows an example in which the shock absorbing liner has two layers, with a less foaming (high density) layer 21 being in contact with shell 10 while a highly foaming (low density) layer 22 being formed for the inside (head). The less foaming layer 21 and the highly foaming layer 22 are joined with an adhesive, which is not restrict and a method of heat welding or other similar welding may also be used.

As described above, by making a double layered structure of the less foaming layer 21 and the highly foaming layer 22, the impact shock is widely dispersed and absorbed in two stages, the pressure from the less foaming layer 21 to highly foaming 22 is moderated. And the highly foaming layer 22, which has a comparatively low density, effectively absorbs the pressure while easily being compressed and transformed. Thus, without remarkably increasing the thickness of the shock absorbing liner 20, excellent shock reducing performance is provided and the shock absorbing liner 20 of this embodiment enables the helmet H to protect a user's head from impact shock.

For the shock absorbing liner 20, any of the following cases may be chosen that both the less foaming layer 21 and the highly foaming layer 22 are made of AS foam, the less foaming layer 21 is made of PS foam as "a foam of other material" and the highly foaming layer 22 is made of AS foam, or the less foaming layer 21 is made of AS foam and the highly foaming layer 22 is made of PS foam as "a foam of a material other than acrylonitrile-styrene copolymer resin". In this embodiment, PS foam is taken to be used as "a foam of other material" or "a foam of a material other than acrylonitrile-styrene copolymer resin", which is not restrict and polypropylene (PP) foam, polyurethane, polyurethane/ethylene-vinylacetate copolymer and the like may also be used.

The reason that not only AS foam but also PS foam may be used is as follows. That is, in terms of such efficiencies as impact shock absorption, impact shock absorption upon a second hit on and after, heat resistance or the like, it is desirable to use acrylonitrile-styrene copolymer resin foam as both the less foaming layer and the highly foaming layer, which is able to provide a production with the highest quality. However, the cost of AS is expensive compared with PS.

Therefore, with a helmet of such low standard that is classified in type A (directed to a vehicle having an exhaust capacity of 125 cc or less) of the types (A, B, C) of helmets, defined in "Protective Helmets for Vehicular Users" of Japanese Industrial Standards, the constitution in which either one of the less foaming layer 21 or the highly foaming 22 is made of PS foam may provide a sufficient quality. On the other hand, if both the less foaming layer 21 and the highly foaming layer 22 are made of AS foam, the quality of the production may become excessive and, the cost may not be suitable.

Accordingly, it is suitable to adapt the use of AS foam and PS foam to the purposed quality. For example, in type A, that is aimed at Snell M 95 Standard, which is higher than type A to C standard of Japanese Industrial Standards, AS foam is to be used as both the less foaming layer 21 and the highly foaming layer 22. And in type B, aimed at C standard of Japanese Industrial Standards, PS foam is to be used as the less foaming layer and AS foam is to be used as the highly foaming layer.

The highly foaming layer 22 on inside generally carries the smaller volume and lighter weight than the less foaming layer 21 on outside. Accordingly in terms of the efficiencies (impact shock absorption, impact shock absorption upon a second hit on and after, heat resistance, etc.) and cost, the highest is "a production, in which both the less foaming layer 21 and the highly foaming layer 22 are made of AS foam", and "a production in which the less foaming layer is made of AS foam and the highly foaming layer 22 is made of PS foam" comes the second, then "a production in which the less foaming layer are made of PS foam and the highly foaming layer 22 is made of AS foam" is the lowest.

Comparative Test 1

A comparative test was performed in order to compare AS foam and PS foam in terms of heat resistance. Specifically, the test investigated dimensional shrinkage (%) at a high temperature of 75° C. or higher. The procedure and the results of the test are described below.

Samples of AS foam and PS foam, each having been prepared so as to have a density of 0.03 g/cm3, were placed in a thermostatic chamber which had been adjusted to a preset temperature between 75° C. and 105° C. The samples were left in the thermostatic chamber for seven days. Thereafter, the samples were removed from the thermostatic chamber, and the size (i.e., the length between reference lines) of each sample was measured. For each type of sample, the size as measured after seven days' treatment in the chamber was subtracted from the size as measured before treatment, and the result was divided by the size as measured before treatment and multiplied by 100, to thereby obtain dimensional shrinkage (%).

Figure 4:
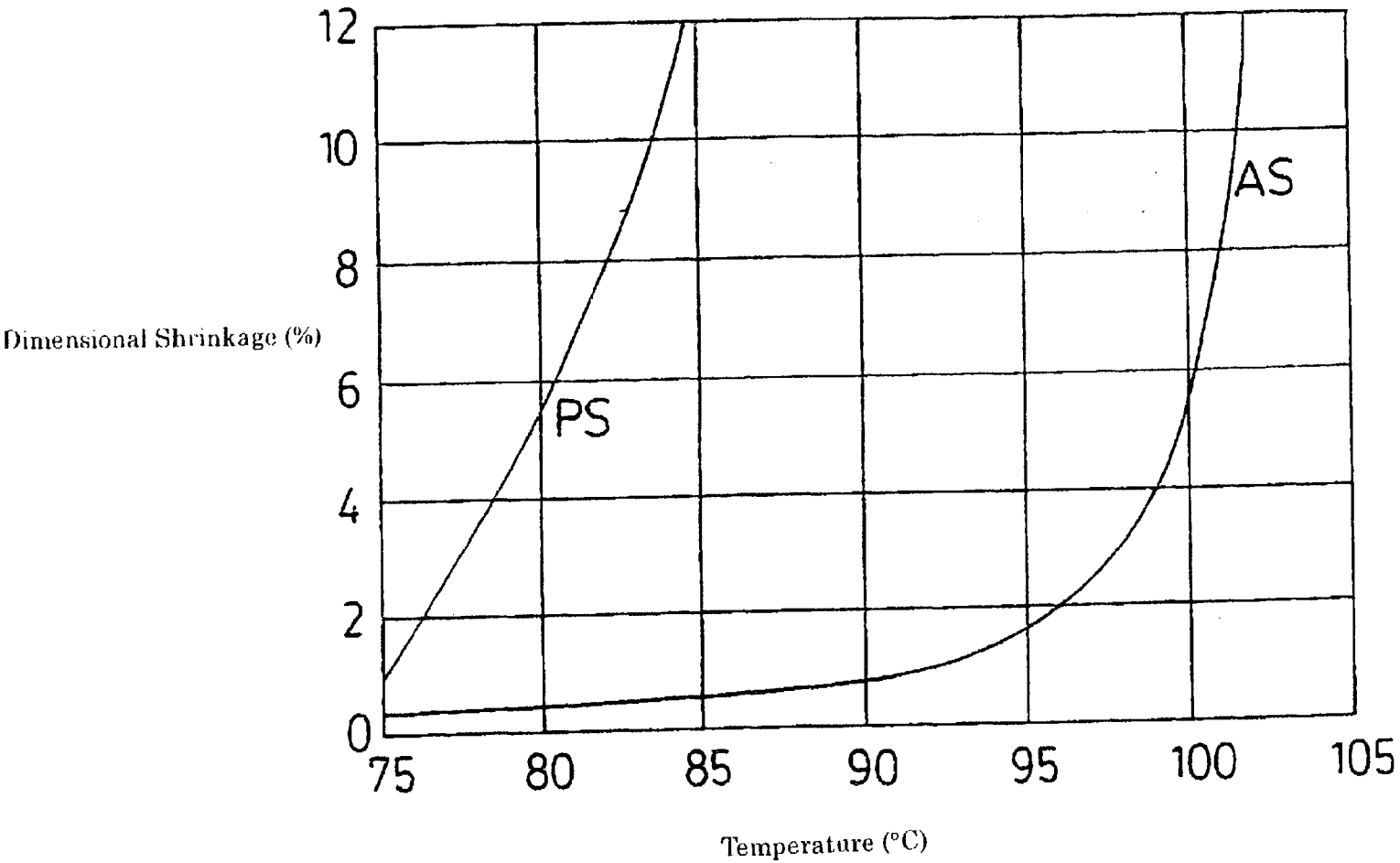
FIG. 4 is a graph showing the test result of heat resistance of AS foam and PS foam.

FIG. 4 is a graph showing percent dimensional shrinkage of AS and PS foam samples obtained in the above-described test at different temperatures. As is apparent from FIG. 4, at a high temperature of 75° C. or higher the percent dimensional shrinkage of AS foam is lower than that of PS foam, proving that AS foam has high heat resistance.

Comparative Test 2

An impact test was performed in order to compare AS foam with PS foam in terms of impact value at ambient temperature, high temperature, and low temperature; specifically, at 23° C. (ambient temperature), 50° C. (high temperature), and −10° C. (low temperature). The method and the results of the test are described below. The impact value was measured as follows. First, without permitting vibration, a striker for a shock absorption test having a sample affixed on the surface thereof was allowed to fall from a predetermined height onto a steel anvil. The impact transmitted via the sample when the predetermined impact point of the sample struck the steel anvil was measured by use of an accelerometer and a recording apparatus connected thereto.

Figure 5:
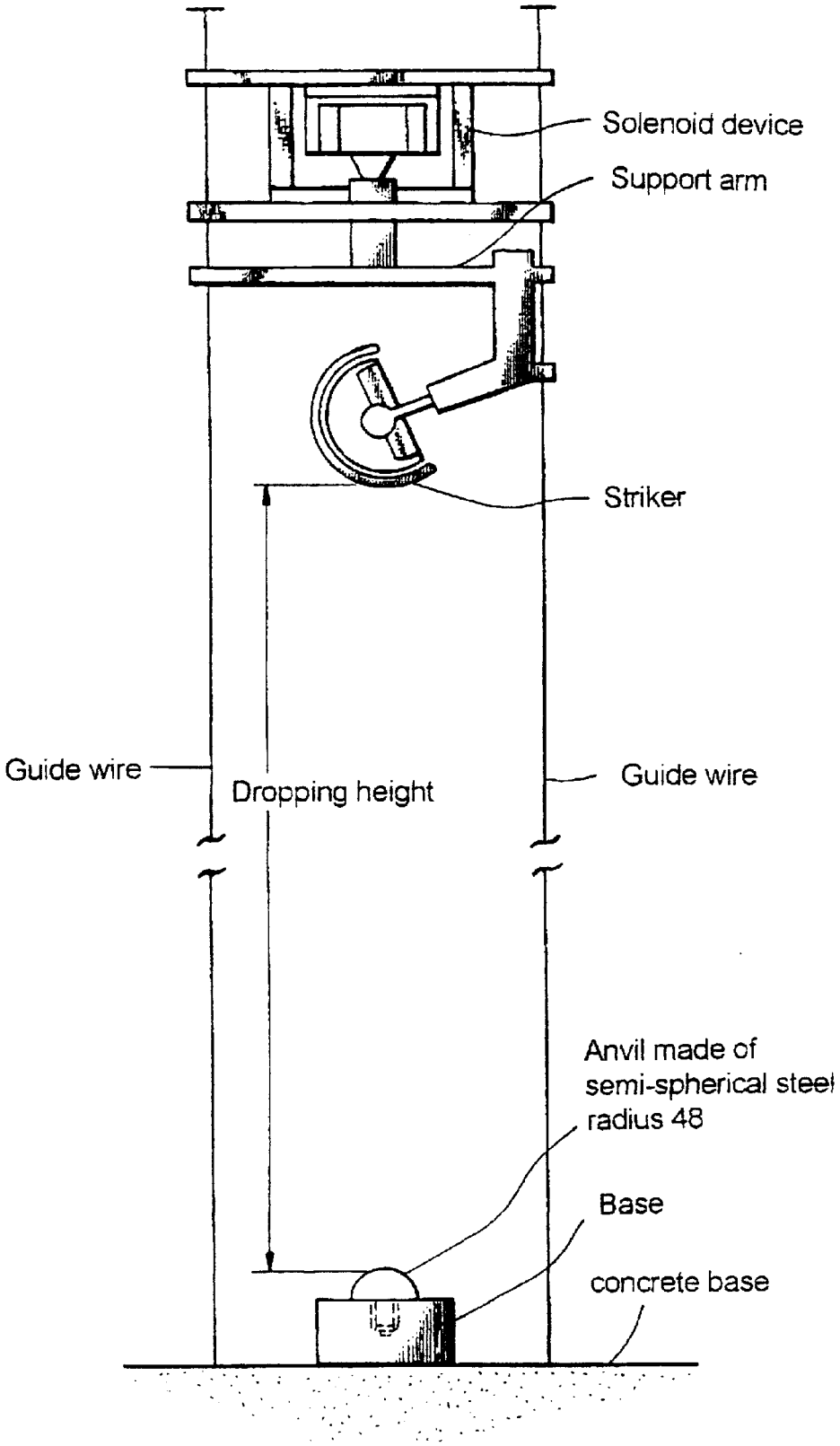
FIG. 5 is a schematic view of an impact shock absorption test device.
Figure 6:
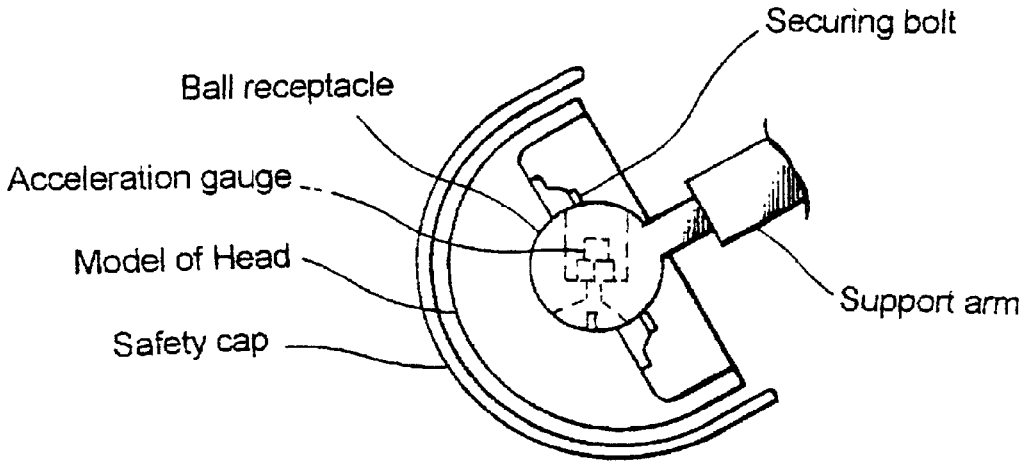
FIG. 6 is a schematic view of a striker used in the impact shock absorbing test.

This impact test employed AS and PS foam samples having a variety of densities; i.e., 43 kg/m3, 57 kg/m3, 74 kg/m3, and 105 kg/m3. The testing apparatus employed was an apparatus for shock absorption test described in the specification for hard hats and safety hats in Japanese Industrial Standards (JIS T8133), as shown in FIG. 5. In this test, a hemispheric steel anvil as shown in FIG. 5 was used. As shown in FIG. 6, a test piece 30, which comprises a liner material 31 serving as a test sample having a thickness of 30 mm and a polyamide (nylon) plate 32 having a thickness of 3 mm superposed on the liner material, was affixed to the outer surface of a striker. The test piece has a size of 100 mm×100 mm.

AS and PS foams were subjected to an impact test at ambient temperature, high temperature, and low temperature as described below. First, test pieces were subjected to pretreatment. Briefly, each sample was placed in a thermostatic chamber at a temperature of 50±2° C., −10±2° C., or 23±2° C. for at least four hours. Subsequently, a test piece 30 was affixed to a striker for the shock absorption test as shown in FIG. 6, and the striker with the test piece affixed was dropped without permitting vibration from a height of 138 cm onto the steel anvil, to thereby measure an impact value. After the first drop, the second and the third falling impact tests were performed without intermission in order to measure impact values. The drop test was repeated so that the point serving as the impact point is always the same, and the first to third tests were performed within three minute after the test piece 30 was removed from the thermostatic chamber.

Table 1 shows the impact values obtained from the above-described tests at the three temperatures. As is apparent from Table 1, when AS and PS foams have a low density, the impact value of AS foam is lower than that of PS foam in a high temperature atmosphere of 50° C.

Table 1

As is also apparent from Table 1, AS foam of low density provides a low impact value at a low temperature of −10° C., and the impact value of AS foam of low density is lower than that of PS foam of low density.

As is also apparent from Table 1, at any one the three temperatures, the impact values of AS foams are remarkably lower than those of PS foams when these foams are hit on the impact point two or three times. Therefore, AS foam is superior to PS foam in terms of recovery after compression.

Comparative Test 3

A comparative test was performed in order to compare AS foam with PS foam in terms of recovery after compression. The method and the results of the test are described below.

Before this test was performed, a test piece of liner material was subjected to an impact load test, which is an evaluation test of shock absorbing material for packaging specified by Japanese Industrial Standards (JIS Z0235). The thickness of the test piece of liner material was measured 24 hours after the impact load test. The thus-measured thickness of the test piece was divided by the initial thickness of the test piece, and the result was multiplied by 100, to thereby obtain the percent recovery. Test pieces of AS foam and PS foam having a density of 0.03 g/cm3 were used in this test.

In the impact load test, the thickness of a test piece of liner material and the stress and impact applied to the test piece were measured, in the case of a flat plate subjected to dropping from a predetermined height onto the test piece. Also, changes in stress, impact value, and thickness of a test piece with the weight of the flat plate were measured. In this test, the percent recovery was measured in the case in which a static stress applied to a test peace fell within a range of about 0.05 kg/cm3 to 0.15 kg/cm3 when a flat plate was dropped from a height of 40 cm onto the test piece.

Figure 7:
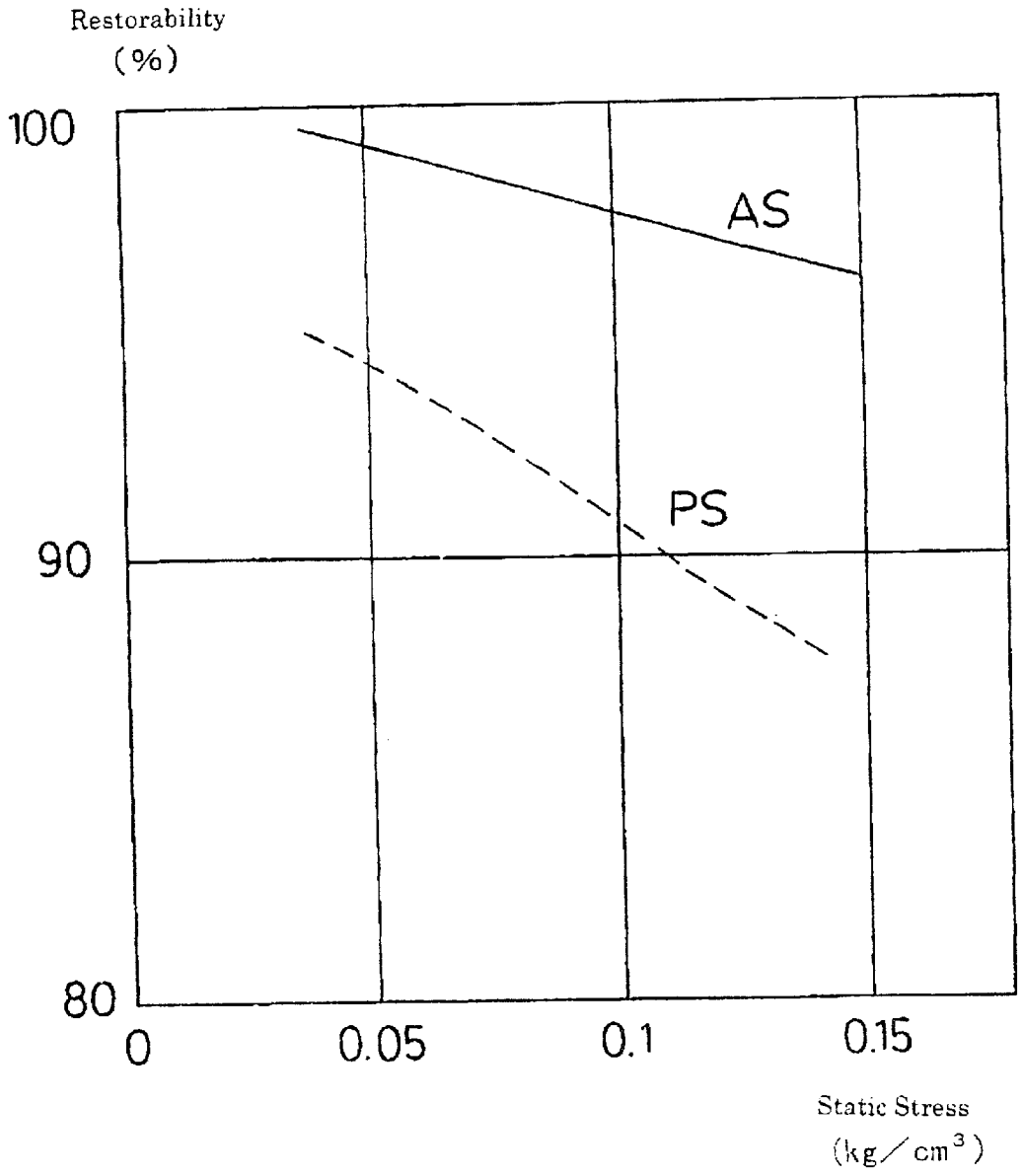
FIG. 7 is a graph showing the test result of restoration of AS foam and PS foam.

FIG. 7 shows the relation between percent recovery and static stress, obtained from the above test. As is apparent from FIG. 7, the rate of recovery of AS foam is higher than that of PS foam when the static stress falls within a range of about 0.05 kg/cm3 to 0.15 kg/cm3.

INDUSTRIAL APPLICABILITY

According to the present invention, the following effects can be obtained:

(1) A helmet showing excellent impact shock absorption, high storability, and excellent impact shock absorption upon a second hit on same spot, can be obtained.

(2) A helmet which has high heat resistance and does not shrink, swell or deteriorate when it is exposed to the atmosphere of high temperature, can be obtained.

(3) Further, a light helmet in which its shock absorbing liner is not thick, can be obtained. Furthermore, the helmet of the present invention is able to be produced without using fleon.

| Impact test in an atmosphere of ambient temperature high temperature, or low temperature | | | | | | | | | | |
|---|---|---|---|---|---|---|---|---|---|---|
| | | Impact value Atmosphere | | | | | | | | |
| | | Ambient temp. (23° C.) | | | High temp. (50° C.) | | | Low temp. (−10° C.) | | |
| | Density | Number of hits | | | | | | | | |
| Material | (kg/m$^3$) | 1 | 2 | 3 | 1 | 2 | 3 | 1 | 2 | 3 |
| AS | 43 | 130 | 411 | — | 135 | 440 | — | 129 | 440 | — |
| PS | 43 | 209 | — | — | 301 | — | — | 150 | 643 | — |
| AS | 57 | 135 | 225 | 399 | 125 | 277 | — | 135 | 213 | 371 |
| PS | 57 | 125 | 499 | — | 138 | 514 | — | 126 | 538 | — |
| AS | 74 | 153 | 188 | 221 | 145 | 185 | 217 | 154 | 196 | 242 |
| PS | 74 | 142 | 212 | 383 | 137 | 232 | 410 | 150 | 208 | 336 |
| AS | 105 | 179 | 214 | 242 | 167 | 201 | 226 | 187 | 229 | 258 |
| PS | 105 | 180 | 224 | 254 | 167 | 207 | 239 | 185 | 223 | 367 |

Note: "—" indicates that the test was not performed because high impact was expected.

What is claimed is:

1. A helmet having a shell formed by molding of a thermoplastic resin and a shock absorbing liner disposed on the inside of the shell, in which the liner comprises a layer formed of acrylonitrile-styrene copolymer resin foam.

2. A helmet as defined in claim 1, wherein the liner comprises a single layered structure formed of acrylonitrile-styrene copolymer resin foam.

3. A helmet as defined in claim 1, wherein the liner comprises a double layered structure formed of acrylonitrile-styrene copolymer resin foam and acrylonitrile-styrene copolymer resin foam which is higher foaming than aforesaid acrylonitrile-styrene copolymer resin foam and disposed on the inside of aforesaid acrylonitrile-styrene copolymer resin foam.

4. A helmet as defined in claim 1, wherein the liner comprises a double layered structure formed of acrylonitrile-styrene copolymer resin foam and a foam, made of other material, which is higher foaming than aforesaid acrylonitrile-styrene copolymer resin foam and disposed on the inside of aforesaid acrylonitrile-styrene copolymer resin foam.

5. A helmet as defined in claim 1, wherein the liner comprises a double layered structure formed of a foam of a material other than acrylonitrile-styrene copolymer resin and acrylonitrile-styrene copolymer resin foam which is higher foaming than the aforesaid foam and disposed on the inside of the aforesaid foam.

* * * * *